United States Patent [19]

Nomura

[11] 4,024,845

[45] May 24, 1977

[54] TEMPERATURE RESPONSIVE PNEUMATIC IGNITION TIMING CONTROL DEVICE

[75] Inventor: Isshi Nomura, Toyota, Japan

[73] Assignee: Aisin Seiki Kabushiki Kaisha, Japan

[22] Filed: Feb. 26, 1976

[21] Appl. No.: 661,554

Related U.S. Application Data

[62] Division of Ser. No. 507, 801, Sept. 20, 1974, Pat. No. 3,987,770.

[52] U.S. Cl. ..... 123/117 A; 137/625.4; 251/11

[51] Int. Cl.[2] ..... F02B 9/02

[58] Field of Search ..... 123/117 A; 137/625.4; 251/11

[56] References Cited

UNITED STATES PATENTS

| | | | |
|---|---|---|---|
| 3,788,291 | 1/1974 | Wu | 123/117 A |
| 3,789,811 | 2/1974 | Franz et al. | 123/117 A |
| 3,841,551 | 10/1974 | Ota | 123/117 A |
| 3,930,515 | 1/1976 | Kennedy et al. | 123/117 A |
| 3,954,090 | 5/1976 | Ota et al. | 123/117 A |

*Primary Examiner*—C. J. Husar
*Assistant Examiner*—Paul Devinsky
*Attorney, Agent, or Firm*—Oblon, Fisher, Spivak, McClelland & Maier

[57] ABSTRACT

An ignition timing control device for an internal combustion engine includes a body having at least three ports, the first port of which draws vacuum thereinto, the second port of which draws atmospheric air therein and the third port of which emits vacuum or air therefrom. A first passageway is provided for establishing communication between the first port and the third port, a second passageway is provided for establishing communication between the second port and the third port, and a third passageway is provided for communicating with the first and second passageways. A first valve, provided within the first passageway, is adapted to be open in response to a low temperature value of the engine and to close at intermediate and high engine temperatures, and a second valve, provided within the second passageway, is adapted to close in response to a low temperature value of the engine and to be open at intermediate and high engine temperatures. Similarly, a third valve, provided within the second passageway and interposed between the second port and the second valve, is adapted to open at low and intermediate engine temperatures and to close at high engine temperatures, while a fourth valve, provided within the third passageway, is adapted to close at low and intermediate engine temperatures and to open at high engine temperatures. A temperature sensitive control device responsive to the operating temperature of the engine has an extensible plunger movable from an initial position to a plurality of actuated positions and is disposed within the body for operating the first, second and third valves so as to thereby be capable of reducing the quantity of noxious fumes exhausted from the engine by varying the spark timing of the engine without adversely affecting the engine, such as for example, the lowering of the output power causing a lack of acceleration, or resulting in engine overheating.

6 Claims, 8 Drawing Figures

TEMPERATURE RESPONSIVE PNEUMATIC IGNITION TIMING CONTROL DEVICE

This is a division of application Ser. No. 507,301 filed Sept. 20, 1974, now U.S. Pat. No. 3,987,770.

BACKGROUND OF THE INVENTION

1. Field of the Invention:

The present invention relates generally to improvements in ignition timing control devices for internal combustion engines and more particularly to an ignition timing control device which is capable of varying the spark timing for a motor vehicle internal combustion engine so as to reduce the quantity of noxious gases exhausted from the engine in response to the temperature of the coolant within the engine water jacket without causing auxiliary engine complications such as for example the lowering of engine output power, a reduction in vehicle acceleration, or overheating of the engine.

2. Description of the Prior Art:

It is a common practice to retard the spark timing of a motor vehicle internal combustion engine in order to reduce the quantity of noxious fumes which are discharged by the engine into the atmosphere and which is of course becoming so substantial as to present public health problems due to such air pollution. One conventional spark timing arrangement however which retards the spark timing of the engine uniformly, regardless of engine conditions, causes a substantial reduction in the output power of the engine, a lack of vehicle acceleration, and overheating of the engine, such conditions being particularly acute when the engine operates either at low temperature or under overheating conditions, the rotation of the engine components becoming unstable and the quality of the gases exhausted from the engine becoming still worse.

SUMMARY OF THE INVENTION

Accordingly, it is an object of the present invention to provide an improved ignition control device for an internal combustion engine which is adapted to obviate the above-mentioned conventional drawbacks.

Another object of the present invention is to provide an improved ignition timing control device which is capable of reducing the quantity of noxious gases exhausted from an internal combustion engine without causing the concomitant lowering of the output power of the engine, a loss of vehicle acceleration, overheating of the engine, or similar undesirable effects.

Yet another object of the present invention is to provide an improved ignition timing control device for an internal combustion engine which is capable of controlling the spark timing of the engine in accordance with the engine operating conditions.

Still another object of the present invention is to provide an improved ignition timing control device for an internal combustion engine which is capable of fluidically connecting the vacuum control unit of a distributor with a carburetor having an air intake passageway or of interrupting such vacuum circuit so as to supply atmospheric air to the vacuum control unit through an air cleaner or alternatively, of communicating the air intake passageway with the vacuum control unit and also communicating the air cleaner with the intake passageway so as to supply vacuum and atmospheric air to the vacuum control unit in response to the temperature of the coolant within the engine water jacket which is sensed by means of a temperature sensitive control means secured within the ignition timing control device.

A further object of the present invention is to provide an improved ignition timing control device which is of an exceedingly small size and which is mechanically simple and inexpensive to manufacture.

BRIEF DESCRIPTION OF THE DRAWINGS

Various other objects, features, and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
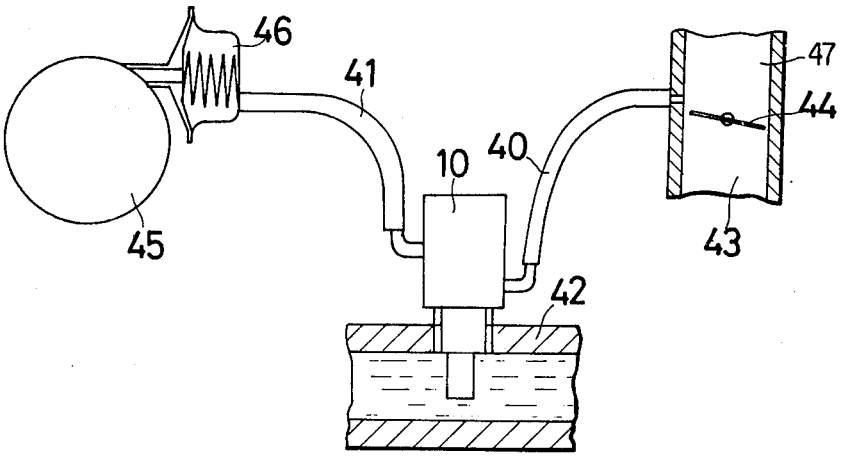
FIG. 1 is a schematic view, partly in section, of a vehicular engine system incorporating an ignition timing control device constructed in accordance with the present invention.

Referring now to the drawings and more particularly to FIG. 1 thereof, a first embodiment for the invention for controlling the spark timing of a motor vehicle internal combustion engine is illustrated as including an ignition timing control device 10 which is fluidically connected with a vacuum control unit 46 of an ignition distributor 45 by means of a conduit 41 and with a carburetor 47, having an intake passageway 43, by means of a conduit 40. As is well known to those skilled in the art, the air intake passageway 43 directs air from the atmosphere to a chamber, not shown, for mixing with the fuel, such as for example, gasoline, the combustible mixture of air and fuel then being directed through the engine intake manifold to the various cylinders of the engine, the amount of such mixture being controlled by means of the throttle valve 44 which is opened and closed as a result of the movement of accelerator pedal. The ignition distributor 45 of course directs electrical current to the various spark plugs or similar engine ignitors in timed relation.

Figure 2:
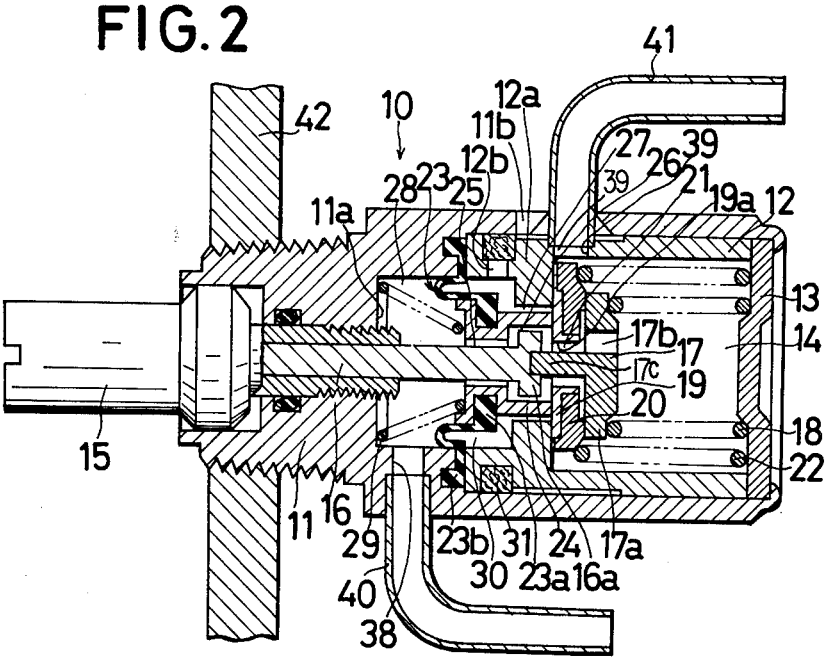
FIG. 2 is an enlarged sectional view of the ignition timing control device utilized within the system of FIG. 1 and showing its cooperative parts.

As more particularly seen within FIG. 2, the ignition timing control device generally indicated by the reference character 10 comprises a body 11 within the right portion of which there is disposed a cylinder 12 which is open at both ends, a port 38 and another port 39 being respectively provided within body 11 and cylinder 12 for fluidically connecting the conduits 40 and 41 with the interior chambers of body 11 and cylinder 12, conduits 40 and 41 being threadedly secured within members 11 and 12. In order to define a chamber 14 within cylinder 12, a body cap 13 is secured to the right end of cylinder 12 and the left end of the body 11 is threaded into the water jacket 42 of the internal combustion engine. A temperature sensitive control means 15, which includes a rod 16 having a flanged portion 16*a* upon the right end portion thereof, is secured within a recess, not numbered, within the left end of body 11 so as to sense the temperature of the coolant being circulated within the water jacket 42. Rod 16 is axially movable within body 11 in response to the temperature which is sensed by the temperature sensitive control means 15 as is well known to those skilled in the art.

A stem portion 17*c* of a spring supporting member 17, which is constantly biased toward the left as a result of the biasing force of a first spring 18 interposed between a flanged portion 17*a* of spring supporting member 17 and body cap 13, is engaged with the flanged portion 16*a* of rod 16. The left surface of an annular sealing member 19, which is secured to an annular valve 20, is held in contact with the right surface of an annular shoulder 12*a* of cylinder 12 and the right surface of valve 20 is similarly held in contact with the left surface of a flanged portion 17*a* of spring supporting member 17. The stem portion 17*c* of spring supporting member 17 is inserted through a bore defined by inner surface 19*a* of annular sealing member 19 so as to define an annular passageway 21 between the outer surface thereof and inner surface 19*a* of the annular sealing member 19. A second spring 22 is similarly interposed betweeen valve 20 and body cap 13 so as to constantly bias valve 20 toward the left and thereby retain sealing member 19 in direct contact with the annular shoulder 12*a* of cylinder 12. Chamber 14 is in constant communication with passage 21 through means of a passageway 17*b* provided within spring supporting member 17.

The outer periphery 23*b* of an annular diaphragm 23 is fixedly secured between a shoulder portion, not numbered, of body 11 and the left end portion of cylinder 12, and the inner periphery 23*a* of diaphragm 23 is secured within an annular recess, not numbered, provided within an annular valve member 24 through which rod 16 is loosely disposed. Valve member 24, rod 16 and flanged portion 16*a* of rod 16 define passageways 25 and 26 and the outer surface of valve member 24 and the annular shoulder 12*a* of cylinder 12 define another passageway 27. The right end portion of valve member 24 is in contact with the left surface of sealing member 19 and another annular chamber 28, defined by means of body 11, rod 16, valve member 24 and diaphragm 23, is in constant communication with the passage 26 through means of passage 25. Within the state shown within FIG. 2, passage 21 is in communication with passage 26, however, such communication between passages 21 and 26 is interrupted when rod 16 moves toward the right and the flanged portion 16*a* of rod 16 contacts the left surface of sealing member 19.

A third spring 29, the biasing force of which is less than that of the second spring 22, is interposed between valve member 24 and an annular shoulder portion 11*a* of body 11, valve member 24 thereby being biased into contact with sealing member 19, that is, as the biasing force of spring 22 is greater than that of spring 29, the sealing member 19 is forced into contact with valve member 24 as well as with shoulder 12*a* of cylinder 12. Another annular chamber 30 is in constant communication with an atmospheric inlet port 11*b*, provided within body 11, through means of annular air cleaner 31, which is radially interposed between body 11 and cylinder 12, and an atmospheric passage 12*b* provided within cylinder 12. Within the state shown within FIG. 2, chamber 30 is in communication with passage 27, however such communication between chamber 30 and passage 27 may be interrupted when the valve member 24 moves toward the right under the influence of the biasing force of spring 29 whereby the right end surface 23*a* of diaphram 23 contacts the left surface of shoulder 12*a* of cylinder 12 so as to enclose chamber 30.

When the temperature of the engine coolant within the water jacket 42 is low, that is, below the normal operating temperature of the engine, the vacuum from carburetor 47 is supplied to the vacuum control unit 46 of the ignition distributor 45 through means of conduit 40, port 38, chamber 28, passageways 25, 26, 21 and 17*b*, chamber 14, port 39, and conduit 41 as illustrated within FIG. 2. As a result, the spark timing of the engine will be advanced in a manner similar to the operation of a conventional ignition timing control device.

When the temperature of the coolant within the water jacket 42 rises to the normal operating temperature of the engine, the temperature sensitive control means 15, in response to the temperature of the coolant within the water jacket 42, gradually moves the rod 16 toward the right against the biasing force of spring 18, which constantly biases the rod 16 toward the left through means of the spring supporting member 17, whereby the right end of the flanged portion 16*a* of rod 16 contacts the left surface of sealing member 19 and consequently the commmunication between the passage 21 and 26 is interrupted. When rod 16 moves still further toward the right against the combined biasing forces of springs 18 and 22, the sealing member 19 is withdrawn from the right surface of shoulder 12*a* of cylinder 12, and consequently, atmospheric air is able to be supplied to the vacuum control unit 46 of the ignition distributor 45 through means of atmospheric inlet 11*b*, air cleaner 31, atmospheric passage 12*b*, chamber 30, passage 27, the gap defined between the left surface of sealing member 19 and the right surface of shoulder 12*a* of cylinder 12, port 39, and conduit 41. In this manner, the spark timing of the engine will be retarded and as a result of such, combustion is substantially complete and the discharge of noxious fumes, such as for example, nitrogen oxides, or incomplete combustion gases exhausted from the engine, are substantially reduced.

When the temperature of the coolant within the water jacket 42 is high, that is, above the normal operating temperature of the engine, rod 16 moves still yet further toward the right and as a result, the right end of valve member 24 becomes separated from the left surface of sealing member 19 while at the same time, the right end surface of the inner peripheral portion 23*a* of diaphram 23 contacts the left side surface of annular shoulder 12*a* of cylinder 12, as a result of the biasing force of the spring 29 the communication between chamber 30 and passageway 27 thereby being interrupted. Vacuum from carburetor 47 is thus able to again be supplied to the vacuum control unit 46 of the ignition distributor 45 through means of conduit 40, port 38, chamber 28, passages 25 and 26, the gap defined between the left side surface of sealing member 19 and the right side surface of shoulder 12*a* of cylinder 12 and the right end of valve member 24, port 39, and conduit 41. In this manner, the spark timing of the engine will be advanced during the period when the temperature of the coolant within the water jacket 42 is lower than the predetermined temperature. The operation of the ignition timing control device 10 will become even further apparent by reference to the graphical representations illustrated within FIGS. 3 and 4.

Figure 3:
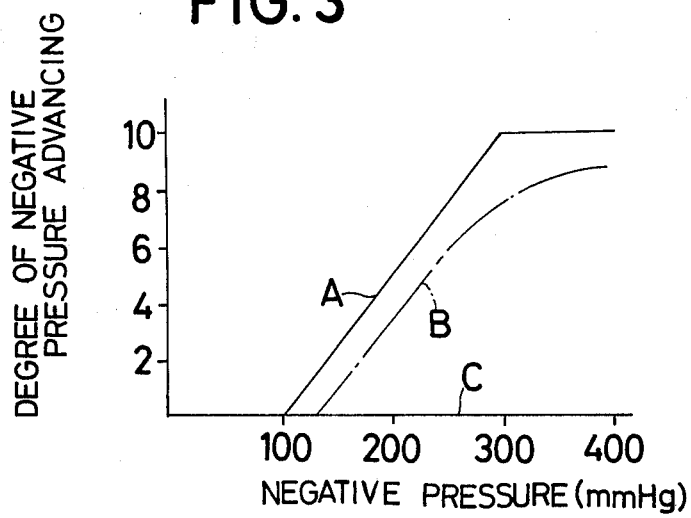
FIGS. 3 and 4 are graphical representations showing the relations between the negative pressure and the degree of negative pressure advancing within a vacuum control unit of a distributor, and between the degree of negative pressure advancing within the vacuum control unit and the engine load, respectively, utilizing the device shown in FIG. 2.
Figure 4:
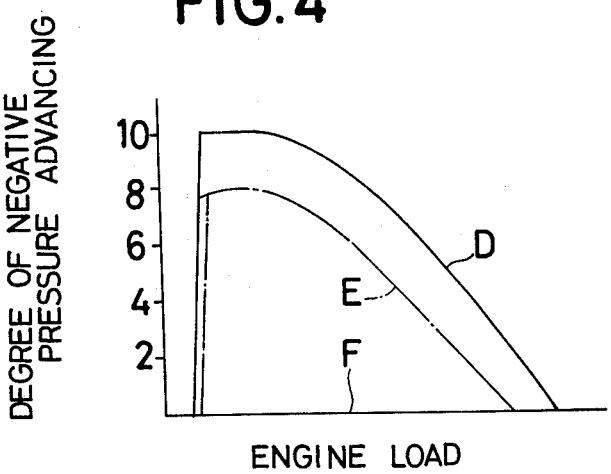

FIGS. 3 and 4 show the relations between the negative pressure and the degree of negative pressure advancing within the vacuum control unit 46 of distributor 45 and between degree of negative pressure advancing within the vacuum control unit 46 of distributor 45 and the engine load when the revolutions of the engine is constant, respectively. Curves A and D show the relative data for a conventional ignition timing control device and the ignition timing control device of the present invention, respectively, when the same are operated at low and high engine temperatures, curves B and E show the relative data for a conventional device when the same is operated at intermediate engine temperatures, and curves C and F show the relative data for the ignition timing control device of the present invention when it is operated at the intermediate engine temperatures. More particularly, when the temperature of the engine is either low or high, the ignition timing control device 10 of the present invention supplies vacuum to the vacuum control unit 46 in a manner similar to the operation of the conventional ignition timing control device. However, when the temperature of the engine is at an intermediate value, the ignition timing control device 10 does not supply vacuum to the vacuum control unit 46, but to the contrary supplies atmospheric air to the vacuum control unit 46. Consequently, the ignition timing control device 10 is capable of reducing the quantity of noxious gases exhausted from the engine by varying the spark timing of the engine without causing undesirable auxiliary engine complications, such as, for example, a reduction in the engine output power, a lack of vehicle acceleration, or overheating of the engine.

Figure 5:
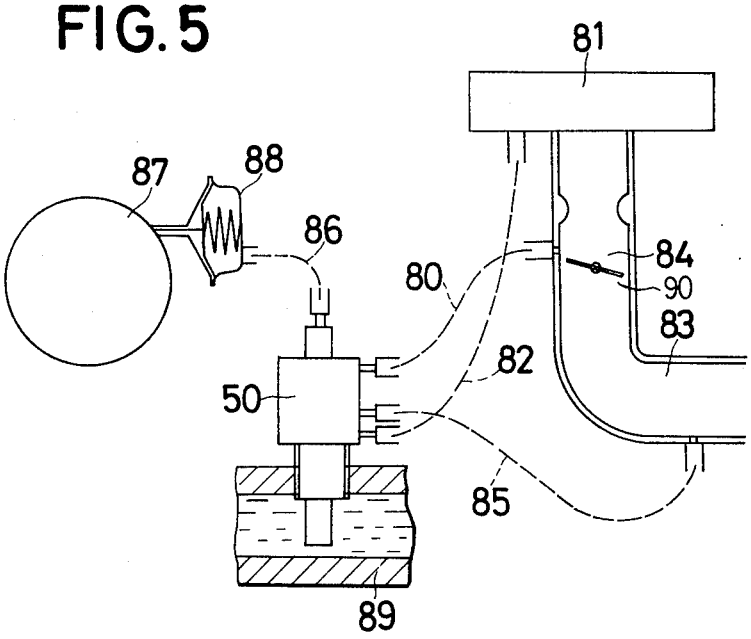
FIG. 5 is a view similar to that of FIG. 1 showing however a system incorporating another control device constructed in accordance with the present invention.

Referring now to FIG. 5, there is shown another embodiment of the present invention, the ignition timing control device being generally indicated by the reference character 50 and being connected with a vacuum control unit 88 of an ignition distributor 87 by means of a conduit 86 as well as with a carburetor 84 by means of a conduit 80, an air intake passageway 83 provided with a throttle valve 90 by means of conduit 85, and with an air cleaner 81 by means of conduit 82, conduits 86 and 80, and 85 and 82 being respectively threaded into and fluidically connected with ports 70 and 71, and 72 and 73 respectively provided within body cap 54 and body 51. The ignition timing control device 50 is more particularly illustrated within FIG. 6 and seen to include a body 51 to which is secured a body cap 54 at the right end portion thereof. The left end portion of body 51 is threaded into the engine water jacket 89 and a temperature sensitive control means 52, which includes a rod 53 having a flanged portion 53*a* at the central portion thereof and a flanged portion 53*b* at the right end portion thereof, is secured within the left end portion of body 51. The operation of the temperature sensitive control means 52 including rod 53 is similar to the temperature sensitive control means 15 including rod 16 as shown within the first embodiment, the explanation of which is therefore omitted herefrom.

A first spring 56 is disposed within a chamber 55 defined by means of body cap 54 and the flanged portion 53*b* of rod 53 so as to constantly bias rod 53 toward the left. The outer peripheries 57*b* and 58*b* of a pair of annular diaphragms 57 and 58 disposed in opposition to each other are fixedly secured between body 51 and body cap 54. The axially outer surfaces of the radially inner portions 57*a* and 58*a* of the diaphrams 57 and 58 are in contact with the flanged portion 53*b* of rod 53 and an annular shoulder 51*b* of body 51 respectively, and the axially inner surfaces of portion 57*a* and 58*a* are respectively held in contact with spring supporting members 59 and 60 through which rod 53 is lossely disposed. Diaphragms 57 and 58, spring supporting members 59 and 60, and rod 53 define a chamber 61 and a second spring 62, the biasing force of which is less than that of first spring 56, is interposed between both spring supporting members 59 and 60 whereby portion 57*a* of diaphragm 57 and portion 58*a* of diaphragm 58 are biased apart so as to firmly contact the left surface 53*e* of the flanged portion 53*b* of rod 53 and shoulder 51*b* of body 51, respectively. Chamber 61 communicates with a chamber 63, defined by body 51, diaphram 58 and flanged portion 53*a* of rod 53, through means of an axial passage 64 defined between the inner surface of annular spring supporting member 60 and the outer peripheral surface of rod 53 and the flanged portion 53*a* of rod 53 is provided with an eccentric passage 53*c* so as to provide comunication between chambers 61 and 63 when the flanged portion 53*a* of rod 53 contacts diaphragm 58 as a result of the rightward movement of rod 53.

Figure 6:
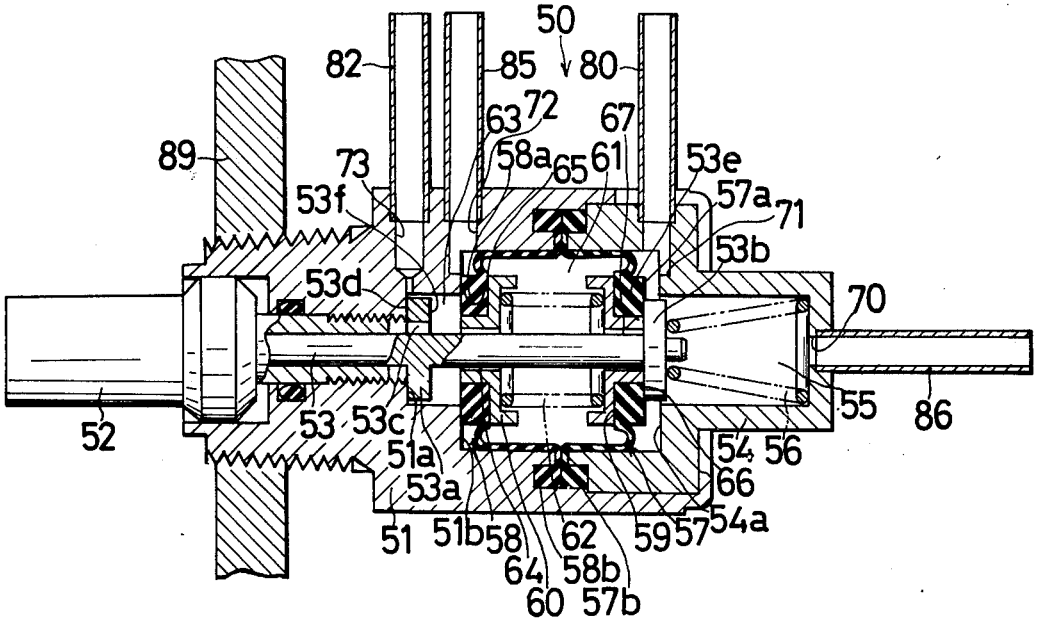
FIG. 6 is a view similar to that of FIG. 2 showing however the control devices incorporated within the system of FIG. 5.

When the temperature of the coolant within water jacket 89 is below the normal operating temperature of the engine, vacuum from carburetor 84 including air intake passageway 83 is supplied to the vacuum control unit 88 of the ignition distributor 87 through means of conduit 80, port 71, chamber 55, port 70, and conduit 86 as illustrated within FIG. 6. In this manner, the spark timing of the engine will be advanced since vacuum is being supplied to the vacuum control unit 88.

When the temperature of the coolant within the water jacket 89 reaches the normal operating temperature of the engine, the temperature sensitive control means 52, in response to the temperature of the coolant within water jacket 89, gradually moves rod 53 toward the right against the biasing force of spring 56 whereby the inner portion 57*a* of diaphragm 57 comes into contact with a shoulder 54*a* of body cap 54 and consequently fluidic communication between carburetor 84 and vacuum control unit 88 is interrupted. Further rightward movement of rod 53 serves to separate the left surface 53*e* of flanged portion 53*b* of rod 53 from the inner portion 57*a* of diaphram 57 so as to thereby define a gap 66 with portion 57*a* of diaphragm 57. In this manner, communication between conduit 80 and chamber 55 is interrupted while communication between chamber 55 and chamber 61 is established through means of passage 66 and 67. As a result, atmospheric air is supplied to the vacuum control unit 88 through means of air cleaner 81, conduit 82, port 73, chamber 63, passage 64, chamber 61, passages 67 and 66, chamber 55, port 70 and conduit 86, whereby the spark timing of the engine will be retarded, combustion is substantially complete, and the discharge of noxious fumes, such as for example, nitrogen oxide or incomplete combustion gases exhausted from the engine, are substantially reduced.

When the temperature of the coolant within the water jacket 89 rises above the normal operating temperature of the engine, rod 53 moves still further toward the right so as to move diaphram 58 toward the right as a result of the contact between the right surface 53*i* of the flanged portion 53*a* of rod 53, with the inner portion 58*a* of diaphram 58, such movement serving to separate portion 58*a* of diaphram 58 from shoulder 51*b* of body 51 and thereby form a passageway 65 between portion 58*a* and shoulder 51*b* so as to permit communication between conduit 85 and chamber 63. In this manner, vacuum from the air intake passageway 83 of the carburetor 84 is supplied to the vacuum control unit 88 through means of conduit 85, port 72, passage 65, chamber 63, passageways 53*c* and 64, chamber 61, passageways 67 and 66, chamber 55, port 70, and conduit 86, and simultaneously therewith atmospheric air is also supplied to the air intake passageway 83 through means of air cleaner 81, conduit 82, port 73, chamber 63, passageway 65, port 72, and conduit 85. In this manner, the spark timing of the engine will be advanced, and as the combustible components are rarefied, the exhaust gases from the engine will be purified.

In addition to the effects noted above, the ignition timing control device 50 also forms a vacuum circuit between the vacuum control unit 88 and the air intake passageway 83, and consequently, vacuum is supplied to the vacuum control unit 88 when the throttle valve closes, that is, when the engine is operating under idle conditions. As a result, overheating of the engine will substantially be prevented, particularly when the engine operates under idle conditions. The operation of this embodiment of the ignition timing control device 50 will become further apparent by reference to the graphical respresentations of FIGS. 7 and 8.

Figure 7:
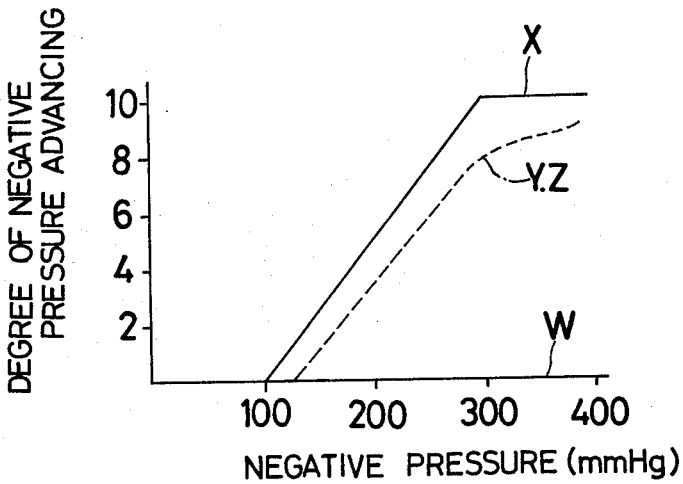
FIGS. 7 and 8 are graphical representations showing the relations between the negative pressure and the degree of negative pressure advancing within a vacuum control unit of a distributor, and between the degree of negative pressure advancing within the vacuum control unit and the engine load, respectively, utilizing the device shown in FIG. 6.
Figure 8:
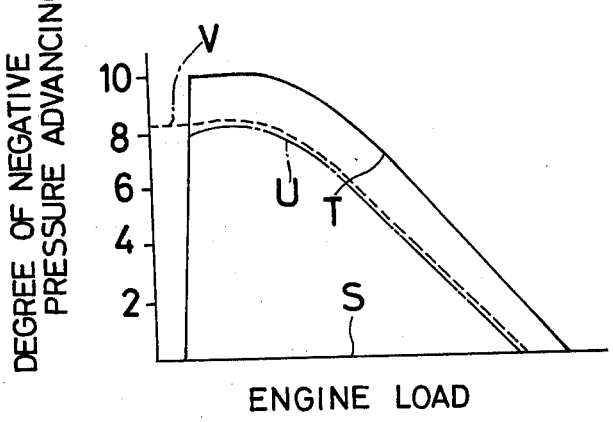

FIGS. 7 and 8 show the relations between the negative pressure and the degree of negative pressure advancing within the vacuum control unit 88 of the distributor 87, and between the degree of negative pressure advancing within the vacuum control unit 88 of distributor 87 and the engine load when the revolutions of the engine is constant, respectively. Curves X and T show the relative data for a conventional ignition timing control device and the ignition timing control device of the present invention when the same are operated at low or high engine temperatures, or low engine temperatures, respectively, curves Y and U show the relative data for a conventional device when the same is operated at intermediate engine temperatures, curves W and S show the relative data for the ignition timing control device of the present invention when the same is operated at the intermediate engine temperatures, and curves X and V show the relative data for the ignition timing control device of the present invention when it is operated at high engine temperatures.

More particularly, when the temperature of the engine is low, the ignition timing control device of the present invention supplies vacuum to the vacuum control unit 88 in a manner similar to the operation of a conventional ignition timing control device. When the temperature of the engine is at an intermediate value, device 50 does not supply vacuum, but to the contrary, atmospheric air to the vacuum control unit 88, and when the temperature of the engine is high, the ignition timing control unit 50 supplies atmospheric air as well as vacuum to the vacuum control unit 88. Still further, when the temperature of the engine is high, the ignition timing control device 50 also supplies vacuum to the vacuum control unit 88 even when the engine operates under idle conditions. The ignition timing control device 50 is thus capable of reducing the quantity of noxious gases exhausted from the engine and is also capable of substantially preventing engine overheating, particulary under idle conditions.

Obviously, many modifications and variations of the present invention are possible in light of the above teachings. It is to be understood therefore that within the scope of the appended claims the present invention may be practiced otherwise than as specifically described herein.

What is claimed as new and desired to be secured to be secured by Letters Patent of the United States is:

1. An ignition timing control device for an internal combustion engine comprising:

a body having means defining an axial bore therein;

first, second, third, and fourth ports communicating with said bore;

a first passageway for establishing communication between said first and second ports;

a second passageway for establishing communication between said first and fourth ports;

a third passageway for communicating said third port with said second passageway;

first valve means provided within said first passageway and adapted to open at low engine temperatures, that is, below the normal operating temperature of the engine, and which is also adapted to close at intermediate engine temperatures, that is, the normal operating temperatures of the engine, as well as at high engine temperatures, that is, above the normal operating temperatures of the engine;

second valve means provided within said second passageway and adapted to close at said low engine temperatures and which is also adapted to open at said intermediate and high engine temperatures;

third valve means provided within said third passageway and adapted to close at said low and intermediate engine temperatures and which is adapted to open at said high engine temperatures;

first operating means for operating said first valve means;

second operating means for operating said second valve means;

third operating means for operating said third valve means;

a temperature sensitive control device responsive to the operating temperature of said engine and having an extensible plunger axially movable within said bore from an initial position corresponding to said low engine temperature to at least one actuated position corresponding to said high engine temperature for operating said first, second, and third operating means; and biasing means for normally biasing said plunger to said initial position.

2. An ignition timing control device as set forth in claim 1, wherein said first valve means comprises:

a first radial projection disposed upon the inner wall of said means defining said bore; and a first valve member having an outer portion which sealingly moves along said inner wall of said means defining said bore, and an inner portion through which said plunger is loosely disposed.

3. An ignition timing control device as set forth in claim 2, wherein said second valve means comprises:

a first radial projection disposed upon said plunger; and said first valve member.

4. An ignition timing control device as set forth in claim 1, wherein said third valve means comprises:

a second radial projection disposed upon said inner wall of said means defining said bore; and a second valve member having an outer portion which sealingly moves along said inner wall and an inner portion through which said plunger is loosely disposed.

5. An ignition timing control device as set forth in claim 4, wherein said first operating means comprises:

second biasing means for normally biasing said first and second valve members in opposite directions with respect to each other; and said first projection of said plunger.

6. An ignition timing control device as set forth in claim 5, wherein said second operating means comprises:

said second biasing means; and a second radial projection disposed upon said plunger and having an axial through-hole disposed radially outwardly of the outer periphery of said plunger.

* * * * *